US005425145A

United States Patent [19]

Baker

[11] Patent Number: 5,425,145

[45] Date of Patent: Jun. 20, 1995

[54] MODULAR PERIMETER SKIMMING GUTTER UNIT FOR SWIMMING POOLS WITH EXPOSED EXTERIOR LONGITUDINAL WELDS

[76] Inventor: William H. Baker, 30 Honeysuckle Woods, Clover, S.C. 29710

[21] Appl. No.: 840,414

[22] Filed: Feb. 24, 1992

[51] Int. Cl.[6] ..... E04H 4/00

[52] U.S. Cl. ..... 4/510; 4/506; 210/169; 52/169.7

[58] Field of Search ..... 220/4.12, 4.17, 410, 220/640, 642; 4/506–512; 52/169.7; 210/169

[56] References Cited

U.S. PATENT DOCUMENTS

| | | | |
|---|---|---|---|
| 3,668,712 | 6/1972 | Baker | 210/169 |
| 4,146,937 | 4/1979 | Baker | 210/169 |
| 4,206,522 | 6/1980 | Baker | 210/169 |
| 4,542,544 | 9/1985 | Baker | 4/510 |

*Primary Examiner*—Robert A. Dawson
*Assistant Examiner*—Robert James Popovics

[57] ABSTRACT

A modular perimeter skimming gutter and retaining wall unit for swimming pools with exposed exterior longitudinal welds, for pool construction by simple bonding together of a plurality of modular units in the shop or on-site, disposed about the perimeter of a swimming pool as the retaining wall of the swimming pool, the modular unit comprising three bonded-together metal sheet portions:

The first sheet being bonded in an exterior bond to the second sheet along a wall of the open first conduit; and to the second sheet along a wall of the closed second conduit, thereby completing the walls of the closed second conduit;

the third sheet being bonded to the second sheet in exterior bonds along a wall of the open first conduit, thereby with the first sheet completing the walls of the open first conduit; and along a wall of the closed second conduit, thereby completing the walls of the closed third conduit.

36 Claims, 11 Drawing Sheets

MODULAR PERIMETER SKIMMING GUTTER UNIT FOR SWIMMING POOLS WITH EXPOSED EXTERIOR LONGITUDINAL WELDS

BACKGROUND OF THE INVENTION

The gutter system of a swimming pool is one of its most important components, and its design is determinative of many of the characteristics of the pool. However, what constitutes good gutter design has long been a perplexing problem in much dispute. What is recognized is that a swimming pool gutter system must provide an adequate surge flow capacity, especially when the pool is filled with swimmers, and it should not flood when a large group of swimmers enters the pool all at once. It should also provide a good surge- and wave-quelling capacity. Its ability to cope with surges and waves produced by swimmers is quite important to the competitive qualities of the swimming pool.

A problem related to gutter design is the removal of surface dirt. Some types of gutter are designed to provide a skimming action, but it has generally been conceded that the most efficient type of skimming action is provided by the scum gutter type of pool, and on all pools over 1,600 square feet in area, scum gutters are provided as a matter of course. In fact, in some states, surface skimmers are not permitted.

One type of swimming pool with a perimeter gutter provides for flow of water over the top of the gutter wall into the gutter trough at all times. Such a gutter system is described in U.S. Pat. No. 2,932,397 to Ogden dated Apr. 12, 1960. Another and older design appears in U.S. Pat. No. 1,797,397 to Booraem dated Mar. 24, 1931. Such a gutter provides a most efficient skimming action under normal flow conditions, but as soon as swimmers enter the pool, or a heavy surge or wave action is encountered, the additional flow of water over the top of the gutter tends to flood the gutter, after which skimming action is lost until the water can be drained away, and in fact some of the dirt already is the gutter may be washed back.

In an attempt to alleviate such a condition, a modification of the Ogden gutter has been proposed in U.S. Pat. No. 3,363,767 to Ellis dated Jan. 16, 1968, incorporating a plurality of skimmer opening spaced around the gutter at a lower level than the top of the gutter. In this system, when the pool is not in use, the skimmer weir is opened and skimming is obtained via the openings into the gutter (column 2, lines 19 to 24). When the pool is in use, the skimmer weirs are closed (column 2, lines 12 to 13), but the water level is held down below the lip of the gutter, providing a certain in-pool surge capacity, and avoiding a flooded gutter condition at the time of flow surges. However, when the pool is in heavy use and there is considerable wave or surge action over the top of the gutter, surface contaminants washed into the gutter may still be washed back into the pool.

U.S. Pat. Nos. 3,668,712 and 3,668,714, patented Jun. 13, 1972 to Baker, provide perimeter skimming gutters for swimming pools which can permit an adequate skimming action at all times, and provide an adequate surge capacity when the pool is in use, without the possibility of the gutter's flooding or dirt in the gutter's being washed back into the pool.

This is accomplished in U.S. Pat. No. 3,668,712 by combining a plurality of narrow, elongated, substantially horizontally disposed openings which are open at all times in a retaining wall disposed about the perimeter of the swimming pool, with the peripheral gutter conduit arranged to receive water spilling over the top of the retaining wall when the flow capacity of the elongated openings is exceeded. The elongated openings can be arranged to feed water into the main gutter conduit, or into a separate second gutter conduit, so as to keep these two water flows completely separate, and retain the dirt skimmed off the top of the pool in a separate place, to avoid the hazard of this dirt's being washed back into the pool, in the unlikely event of the first gutter conduit's being flooded during wave actions or surges. In this gutter system, the water level in the pool is normally maintained at the level of the skimmer openings in the gutter.

In U.S. Pat. No. 3,668,714, the perimeter skimming gutter comprises a first gutter conduit for disposition about the perimeter of a swimming pool, and adapted to carry water at a level below a predetermined level of water in the swimming pool; a retaining wall on the pool-side of the first gutter conduit, over the top of which wall water may flow from the pool into the first gutter conduit; and a second gutter conduit in fluid flow connection with the first, such fluid flow connection entering the first gutter conduit at a level below the top of the retaining wall, and adapted to drain off water from the first gutter conduit at any level exceeding a predetermined maximum level therein, so as to inhibit the level of water in the first gutter conduit from reaching the top of the retaining wall.

U.S. Pat. No. 3,668,713, patented Jun. 13, 1972 to Baker, provides a fluid flow and/or fluid pressure responsive gate weir for swimming pools, comprising in combination, a weir support; a fluid flow passage in the support; a gate member pivotably mounted in the support across the passage between flow-open and flow-closed positions; a gate control means disposed to encounter a fluid flow through and/or fluid pressure in the passage above a predetermined minimum, and responsive to such flow and/or pressure to pivot the gate member from a flow-open towards a flow-closed position; and means arranged to retain the gate member in the flow-open position under normal conditions of fluid flow and/or fluid pressure through the weir passage and to permit pivotal movement of the gate members towards a flow-closed position while such excessive fluid flow and/or fluid pressure continues.

Means can also be provided to return the gate member to the flow-open position when such excessive flow and/or pressure subsides, and/or returns to normal.

U.S. Pat. No. 3,815,160, dated Jun. 11, 1974 to Baker, provides a nonflooding perimeter skimming gutter wall for swimming pools, including a first gutter conduit for disposition about the perimeter of a swimming pool, and adapted to carry water at a level below a predetermined level of water in the swimming pool, a retaining wall on the pool-side of the first gutter conduit over the top of which wall a skimming flow of water may run from the pool into the first gutter conduit, a second gutter conduit within a peripheral wall below the first gutter conduit and adapted to carry water at a level above a predetermined level of water in the first gutter conduit, and a fluid flow connection between the two gutter conduits at such level and below the top of the retaining wall allowing water to flow from the first gutter conduit into the second gutter conduit whenever the water level on the first gutter conduit reaches the fluid flow connection, thereby inhibiting filling of the first gutter conduit appreciably above such level.

In the twin gutter structures provided in these patents, the two gutters are separate, and of fixed dimensions. While the gutters can be interconnected at a number of locations, flow therebetween is normally not possible until one or the other reaches a predetermined overflow level. This is highly desirable in most circumstances, but on occasion a single gutter of large capacity may be preferred. In a fixed-in-place structure of the type described, this is not possible to achieve.

In accordance with U.S. Pat. No. 4,050,104 patented Sep. 27, 1977 to Baker, a twin gutter system is provided in which the twin gutters can be kept separate or combined in one, as desired, by forming the two gutters with at least one common wall, of which at least a portion thereof can be removed. This feature can be applied in any of the twin gutter systems of U.S. Pat. Nos. 3,688,712, 3,668,713, 3,668,714, and 3,815,160 with or without a skimming function, as desired. The common wall can be all or part of a side wall, and end wall, a bottom wall, or a corner wall, of the gutters, as is illustrated in the drawings, which show preferred structural embodiments.

Thus, a perimeter gutter for swimming pools is provided comprising, in combination, first and second gutter conduits for disposition about the perimeter of a swimming pool, which conduits at least one is adapted to carry water at a level below a predetermined level of water in the swimming pool; a retaining wall on the pool-side of the gutter conduits, over the top of which wall water may flow from the pool into one of the gutter conduits; the first and second gutter conduits having at least one common wall therebetween, separating interior space of the second gutter conduit from interior space of the first gutter conduit, of which common wall at least a portion is removable, so that upon removal of the wall, said interior spaces are combined and form a gutter whose interior space is greater than the interior space of either gutter conduit.

The first and second gutter conduits can be in fluid flow communication either with the swimming pool or with each other, or with both.

The perimeter gutter structures of all of these patents is rather complex, and not susceptible of manufacture except at a highly sophisticated manufacturing facility. The gutters are best made as a plurality of units that are welded together on-site according to the pool size and shape required. The large number of exterior and interior walls that have to be welded together in leak-tight seals is formidable, and where these walls come together adjacent multiple joints are required that have to be introduced one at a time, which poses a formidable problem upon introduction of the second weld, so as to avoid opening up of the first weld in the process, besides taking considerable labor time on the part of highly skilled welders. This welding problem is especially severe in assembling the retaining wall, which usually requires installing several modular wall units, one on top of the other, in perfect alignment vertically and horizontally, from one modular unit to the next.

U.S. Pat. No. 4,758,292, patented Jul. 19, 1988 to Baker, provides a simplified pool-side retaining wall structure in which at the junction of three sheets, the walls can all be welded together simultaneously in one weld. The finished retaining wall comprises two conduits in alignment vertically, horizontally, or at any angle thereto, separated by and welded to a common divider wall, in single welds at each end of the divider wall. One side of the retaining wall forms a side retaining wall of the pool, and the other side forms the side wall of a gutter trough.

The modular bonded perimeter skimming gutter retaining wall for swimming pools according to that invention thus is especially designed for construction by simple bonding together of a plurality of modular units on-site, disposed about the perimeter of a swimming pool, as the retaining wall of the swimming pool, defining a pool-side wall of an open gutter conduit adapted to carry water at a level below a predetermined level of water in the swimming pool, over the top of which wall water may flow from the pool into the gutter, the retaining wall comprising two generally U-shaped channels open along one side and having open interiors defined by side walls extending from a common base, the channels being arranged with the open sides facing one another and bonded together along the end faces of the side walls to a common divider plate closing off each channel and the interior spaces thereof, thereby forming separated conduits of each channel, one of said conduits being adapted to carry clean water feed to the pool and the other of said conduits being adapted to carry water away from the pool.

The retaining wall is adapted for combination with a pool-side concrete or other built-in gutter structure at the perimeter of a swimming pool, or with a sheet of material shaped to form and complete the perimeter gutter structure and, in addition, if desired, the top coping of the swimming pool, so as to form a perimeter skimming gutter.

SUMMARY OF THE INVENTION

In accordance with the present invention, there is provided a modular perimeter skimming gutter and retaining wall unit for swimming pools with exposed exterior longitudinal welds, for pool construction by simple bonding together of a plurality of modular units in the shop or on-site, disposed about the perimeter of a swimming pool as the retaining wall of the swimming pool, defining:

(1) an open first conduit,
(2) a closed second conduit,
(3) closed third conduit, and
(4) at least a portion of a pool-side retaining wall, the open first conduit being adapted to carry water at a level below a predetermined level of water in the swimming pool, and over the top of which retaining wall water may flow from the pool into the open first conduit;

the modular unit comprising three bonded-together metal sheet portions:

(a) a first metal sheet so shaped as to define selected walls of the closed second or third conduit and selected walls of the open first conduit;
(b) a second sheet so shaped as to define with first sheet the remaining walls of the closed second conduit; and selected walls of the closed third conduit;
(c) and at least one of the first and second sheets so shaped as to define at least a portion of the pool-side retaining wall;
(d) a third sheet so shaped as to define with the first or second sheets the remaining walls of the open first conduit and of the closed third conduit;

The first metal sheet being bonded in an exterior bond to the second sheet along a wall of the open first conduit; and to the second sheet along a wall of the closed second conduit, thereby completing the walls of the closed second conduit;

the third sheet being bonded to the second sheet in exterior bonds along a wall of the open first conduit, thereby with the first sheet completing the walls of the open first conduit; and along a wall of the closed second conduit, thereby completing the walls of the closed third conduit, and a plurality of apertures through one of the second or third sheets along a wall of the open first conduit for flow of gutter water therefrom into the closed second conduit; and one of the closed second and third conduits being adapted to carry clean water feed to the pool, and the other closed conduit and the open conduit being adapted to carry gutter water away from the pool.

In an especially preferred embodiment of the invention, there is provided a modular perimeter skimming gutter and retaining wall unit for swimming pools with exposed exterior longitudinal welds, for pool construction by simple bonding together of a plurality of modular units in the shop or on-site, disposed about the perimeter of a swimming pool as the retaining wall of the swimming pool, defining:

(1) an upper open gutter conduit, (2) a lower closed gutter conduit, (3) an upper closed water feed conduit, and (4) a pool-side retaining wall, the open gutter conduit being adapted to carry water at a level below a predetermined level of water in the swimming pool, and over the top of which retaining wall water may flow from the pool into the open gutter conduit;

the modular unit comprising three bonded-together metal sheet portions:

(a) a first sheet so shaped as to define at least a portion of the pool-side retaining wall, the bottom and outer walls of the lower closed gutter conduit, and the bottom and rear walls of the upper open gutter conduit, (b) an inverted U-shaped third sheet so shaped as to define with the first sheet the lower gutter conduit;

(c) an inverted U-shaped third sheet so shaped as to define with the first and second sheets the upper open gutter conduit and the upper closed water feed conduit.

The first sheet being bonded in an exterior bond to an end of the second sheet along a bottom corner of the upper open gutter conduit; and to another end of the second sheet along a bottom corner of the lower closed gutter conduit, thereby completing the bottom, top and sides of the lower closed gutter conduit;

the third sheet being bonded in an exterior bond to the second sheet along one side of the upper open gutter conduit, thereby with the first sheet completing the sides and bottom of the upper gutter conduit; and to the second sheet along the bottom corner of the upper closed water feed conduit, thereby completing the sides, top and bottom of the closed water feed conduit, and a plurality of apertures through the second metal sheet along the bottom of the open gutter conduit for flow of gutter water therefrom into the lower closed gutter conduit;

the water feed conduit being adapted to carry clean water feed to the pool, and the upper and lower gutter conduits being adapted to carry gutter water away from the pool.

BRIEF DESCRIPTION OF THE DRAWINGS

Embodiments of the invention are illustrated in the drawings, in which.

DESCRIPTION OF THE PREFERRED EMBODIMENTS

Figure 1:
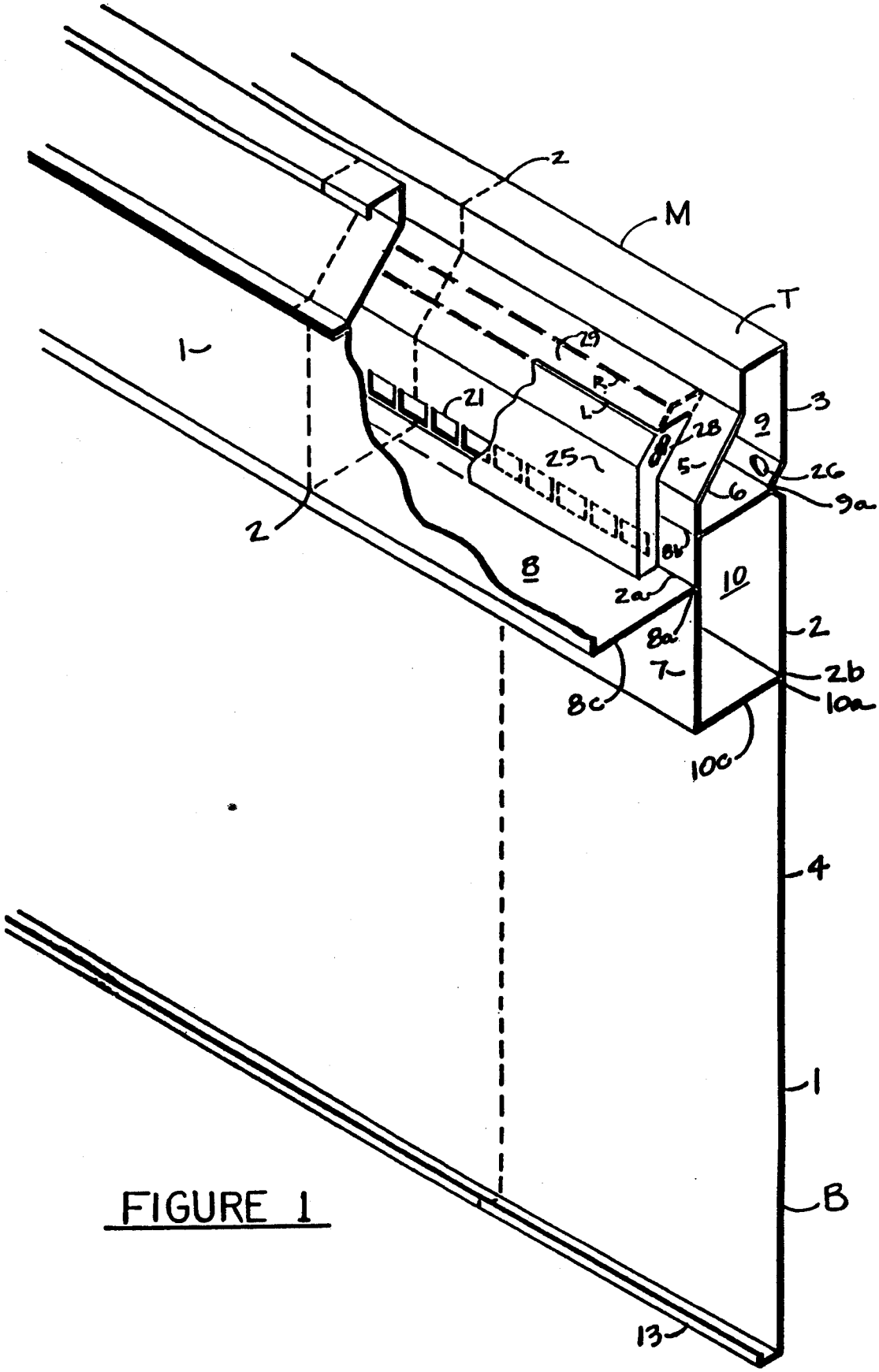
FIG. 1 represents an isometric view of one embodiment of a perimeter skimming gutter and retaining wall unit in accordance with the invention.
Figure 2:
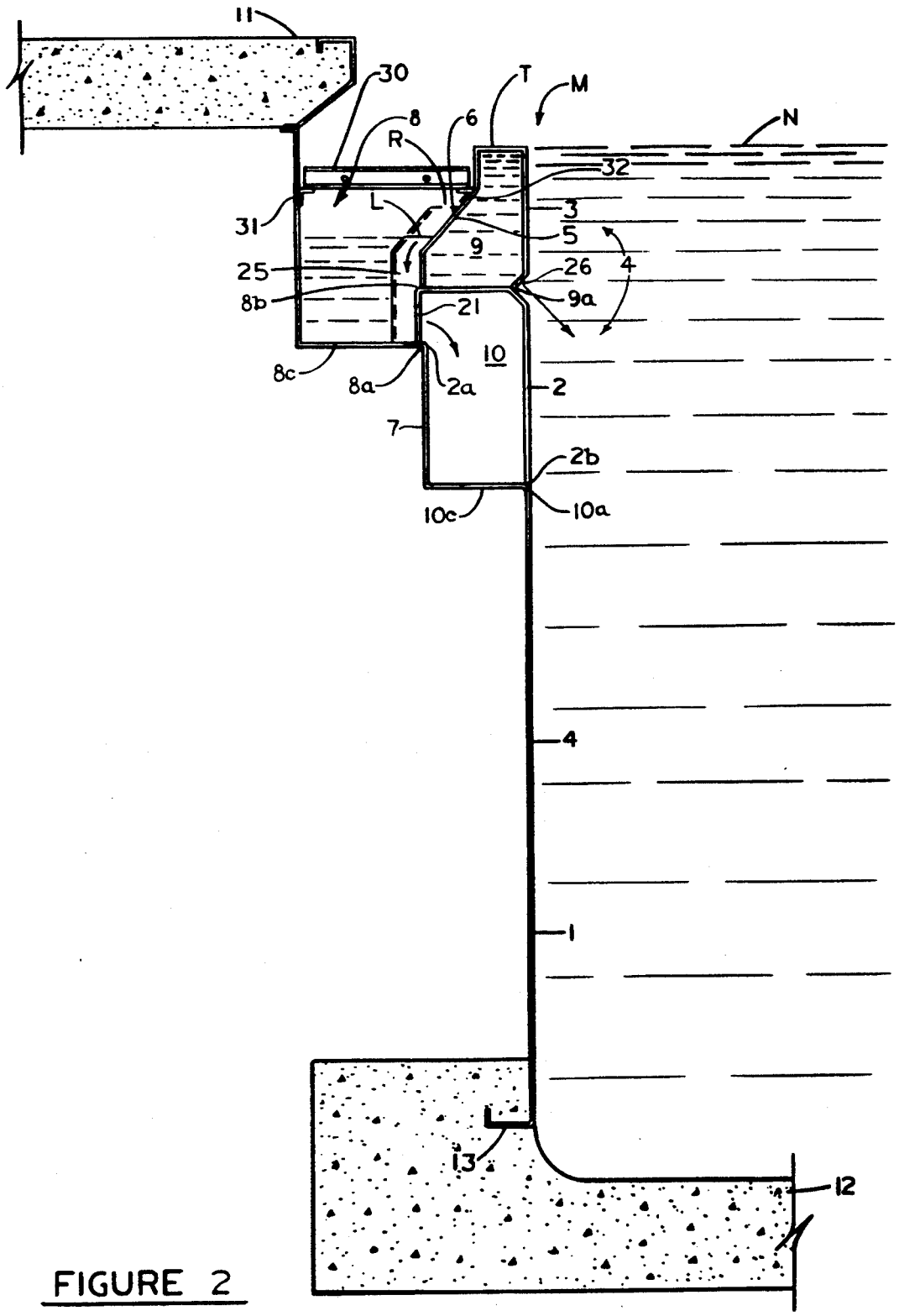
FIG. 2 represents an enlarged view in cross-section taken along the line 2—2 of FIG. 1.

The perimeter gutter and retaining wall unit of FIGS. 1 and 2 is made up as the retaining wall of a swimming pool by combining a number of modular units M which are assembled in-shop or on-site and bonded-together at their ends as at B by welding, soldering or brazing, to form a gutter and pool-side wall extending around substantially the entire circumference of the swimming pool. Each unit M is made of stainless steel sheet, formed from three bonded-together sheets; 1, 2, 3:

(a) a first metal sheet 1 so shaped as to define the pool-side retaining wall 4, the bottom and outer walls of the lower closed gutter conduit 10, and the bottom and rear walls of the upper open gutter conduit 8;

(b) an inverted U-shaped second metal sheet 2 so shaped as to define with the first metal sheet the lower gutter conduit 10;

(c) an inverted U-shaped third metal sheet 3 so shaped as to define with the first and second metal sheets the upper open gutter conduit 8 and the upper closed water feed conduit 9.

The first metal sheet 1 is bonded to an end 2a of the second metal sheet 2 in exterior bonds along a bottom corner 8a of the upper open gutter conduit 8, and to another end 2b of the second metal sheet along a bottom corner 10a of the lower closed gutter conduit 10, thereby completing the bottom, top and sides of the lower closed gutter conduit.

The second metal sheet 2 is bonded to the third metal sheet 3 in exterior bonds along one side 8b of the upper open gutter conduit 8, thereby, with the first metal sheet 1 completing the sides and bottom of the upper open gutter conduit 8, and along the bottom corner 9a of the upper closed water feed conduit 9, thereby completing the sides, top and bottom of the water feed conduit 9.

A plurality of apertures or slots 21 through the second metal sheet 2 along the bottom of the open gutter conduit 8 allow flow of gutter water therefrom into the lower closed gutter conduit 10.

The water feed conduit 9 is adapted to carry clean water feed to the pool, and the upper and lower gutter conduits 8, 10 are adapted to carry gutter water away from the pool.

The pool-side of bonded-together sheets 1, 2 and 3 are designed to serve together as the pool retaining wall 4 on the pool-side of the gutter. The opposite inner sides of bonded-together sheets 1, 2 and 3 serve together as the side wall 5 of the open gutter 8 on the gutter side of the retaining wall, and as the side wall 6 of the water feed conduit 9, and as the side wall 7 of the closed gutter conduit 10.

The top coping 11 is made of concrete, cast in place during construction of the pool, and protrudes over the open gutter trough 8. The pool bottom 12, also of concrete, anchors the bottom end 13 of sheet 1, constituting the lower end of retaining wall 4 of the pool.

The modular units 1 are linked together by welding, soldering and brazing at the butt ends B of the up-standing sides 4, 5, 6 and 7. This can be done in the shop or on-site, during construction of the pool.

The apertures 21, elongated narrow substantially horizontal slots 21 are disposed at a level above the bottom of the gutter trough 8. The slots can be arranged in size and in number so as to provide for a sufficient withdrawal flow of water from the open gutter trough 8 into the lower closed gutter conduit 10 to provide a surge capacity for the trough 8 sufficient to accommodate the surge overflow over the trough of the conduit 9 providing a surge capacity sufficient to accommodate the surge caused by swimmers entering the pool and during their use of the pool without flooding the gutter trough, while at the same time providing and excellent wave-quelling effect (faster calming and faster wave subsidence) because of access to the gutter trough over the top T of the retaining wall. The slots 21 can be at any level above the bottom of the gutter, lower or higher than the level shown.

The adjustable overflow channel 25 in the open gutter trough 8 before the slots 21 can be lowered to position L, as shown, or raised to position R, shown in dashed lines, to control the overflow level to the slots 21 and into the lower closed gutter conduit 10.

FIG. 2 shows the normal water level N of a pool in which this perimeter gutter retaining wall in installed. In the case shown, the normal level is also the limiting level, defined by the top T of the retaining wall. The top provides skimming action over any range of water circulating flow, when the water reaches this level, as for example, with swimmers in the pool.

As shown in FIG. 2, water enters the upper open gutter trough 8 over the top T, then overflows by gravity into the overflow channel 25, and then enters the lower closed gutter conduit 10 via the slots 21, then enters the water recirculating system, passing through the pool water recirculating system to the filter and the pump (not shown, but of conventional design). Thence, the water is returned to the pool by way of the closed water feed conduit 9, and enters the pool via inlets 26. Dirt of a size that can enter the slots 21 is thereby carried away from the gutter trough 8, and removed by the filter.

Each modular unit M has an inlet 26 close enough to the end of the unit to afford visual inspection of the integrity of the bond at that end to the next modular unit.

The open gutter trough 8 is sized to provide a reserve pool water surge capacity, to accommodate the surge created when swimmers enter the pool. Even though in the event of such a surge the gutter level may initially rise above overflow 25, it will be apparent that if the flow into the gutter is normally less than the capacity of the slot system 21, the water level in the gutter will gradually be reduced to the overflow level shown in FIG. 2.

The slots 21 can be arranged in size and in number so as to provide from 1% to 75% open area of the gutter perimeter at the gutter water level. The overflow 25, which is adjustable by slide bolts 28, determines the overflow level in the gutter, as may be required for gutter flow capacity, and in-pool surge capacity sufficient to accommodate the surge caused by swimmers without flooding the gutter trough, while at the same time providing an excellent wave-quelling effect (faster calming and faster wave subsidence) because of access to the gutter trough over the top of the retaining wall of the gutter. The cover plate 29 can be adjustable by any conventional means.

The open gutter trough is covered by a grating 30, removably supported on flanges 31, 32 on the gutter wall.

The pool side retaining wall as shown provides two separate closed conduits 9 and 10, of which either can be used for water feed or gutter flow, as desired, but in the preferred embodiments shown in the drawings the upper conduit 9 is used as a water feed conduit, and the lower conduit 10 as a gutter return conduit.

Figure 3:
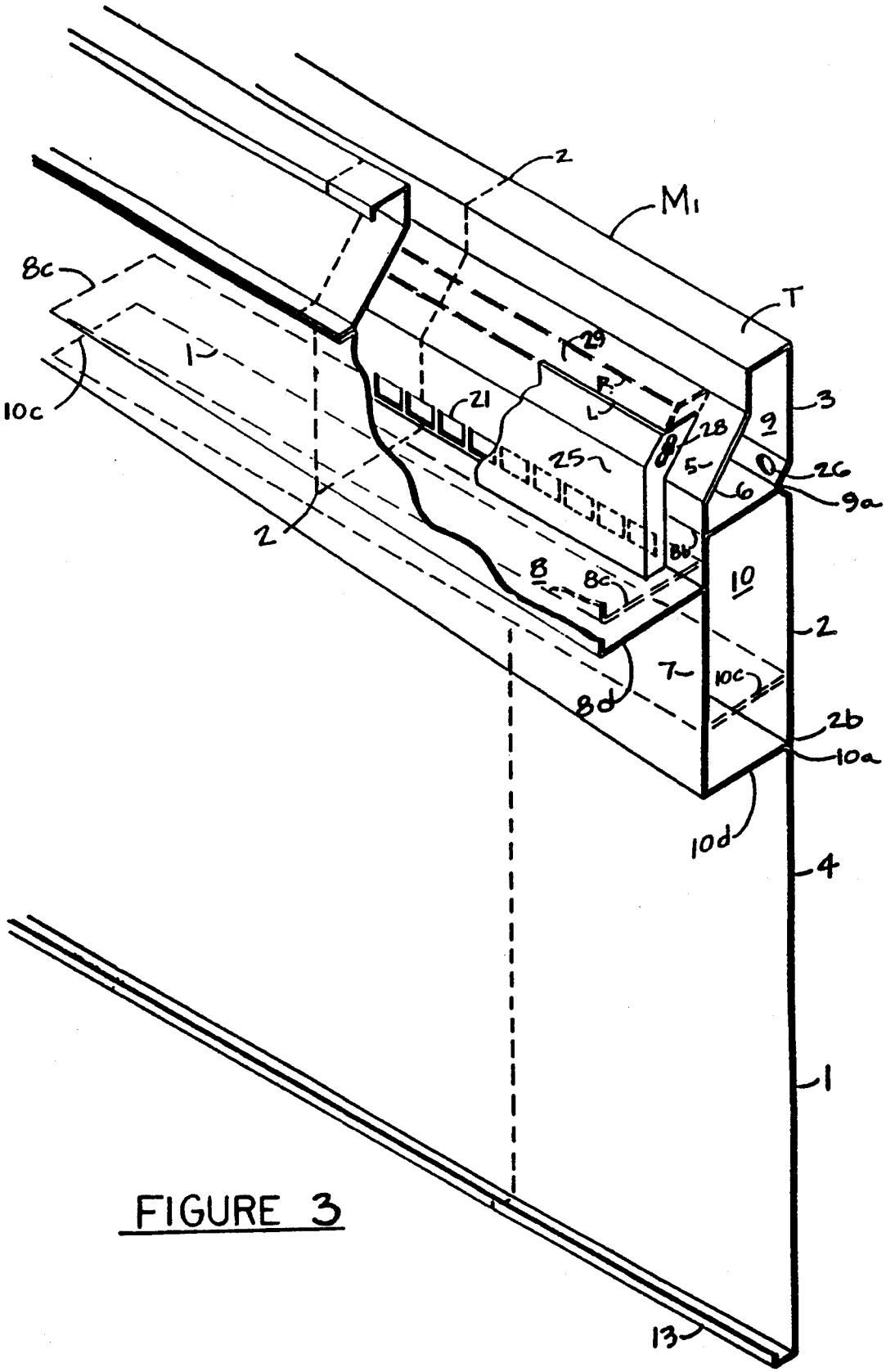
FIG. 3 represents an isometric view of a second embodiment of a perimeter skimming gutter and retaining wall unit in accordance with the invention.
Figure 4:
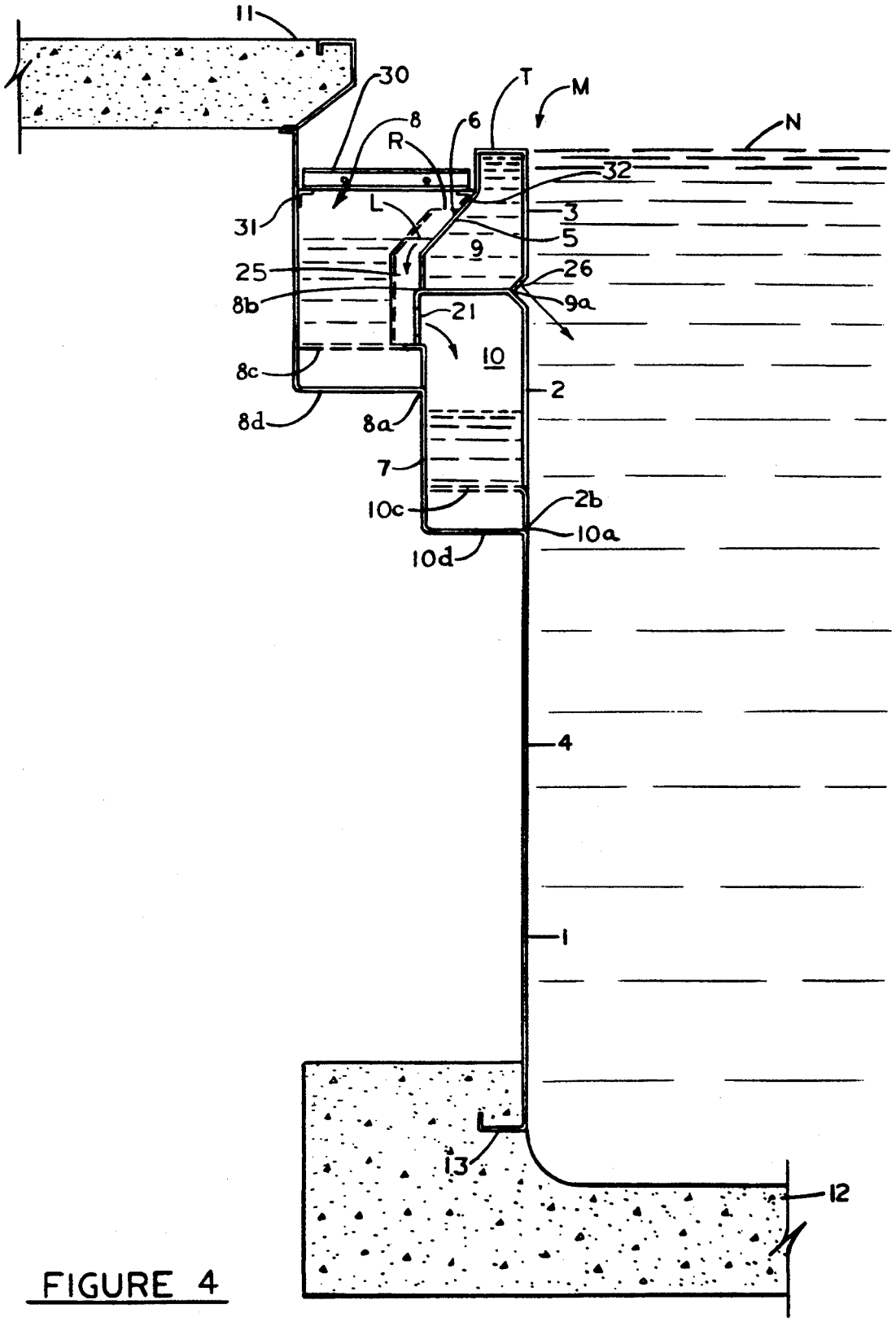
FIG. 4 represents an enlarged view in cross-section taken along the line 4—4 of FIG. 3.

The perimeter gutter and retaining wall unit of FIGS. 3 and 4 is similar to that of FIGS. 1 and 2, and is made up as the retaining wall of a swimming pool by combining a number of modular units M (as seen on FIG. 5) and which are assembled in-shop or on-site and bonded-together at their ends as at B by welding, soldering or brazing, to form a gutter and pool-side retaining wall extending around substantially the entire circumference of the swimming pool. Each unit M is made of stainless steel sheet, formed from three bonded-together sheets; 1, 2 and 3 as in the embodiment of FIGS. 1 and 2:

(a) A first metal sheet 1 so shaped as to define the pool-side retaining wall 4, the bottom and outer walls of the lower closed gutter conduit 10, and the bottom and rear walls of the upper gutter conduit 8;

(b) an inverted U-shaped second metal sheet 2 so shaped as to define with the first metal sheet the lower gutter conduit 10;

(c) an inverted U-shaped third metal sheet 3 so shaped as to define with the first and second metal sheets the upper open gutter conduit 8 and the upper closed water feed conduit 9.

The first metal sheet 1 is bonded to an end 2*a* of the second metal sheet 2 in exterior bonds along a bottom corner 8*a* of the upper open gutter conduit 8, and to another end 2*b* of the second metal sheet along a bottom corner 10*a* of the lower closed gutter conduit 10, thereby completing the bottom, top and sides of the lower closed gutter conduit.

The second metal sheet 2 is bonded to the third metal sheet 3 in exterior bonds along one side 8*b* of the upper open gutter conduit 8, thereby, with the first metal sheet 1 completing the sides and bottom of the upper open gutter conduit 8, and along the bottom corner 9*a* of the upper closed water feed conduit 9, thereby completing the sides, top and bottom of the water feed conduit 9.

A plurality of apertures 21 through the second metal sheet 2 along the bottom of the open gutter conduit 8 allow flow of gutter water therefrom into the lower closed gutter conduit 10.

The water feed conduit 9 is adapted to carry clean water feed to the pool, and the upper and lower gutter conduits 8, 10 are adapted to carry gutter water away from the pool.

Figure 5:
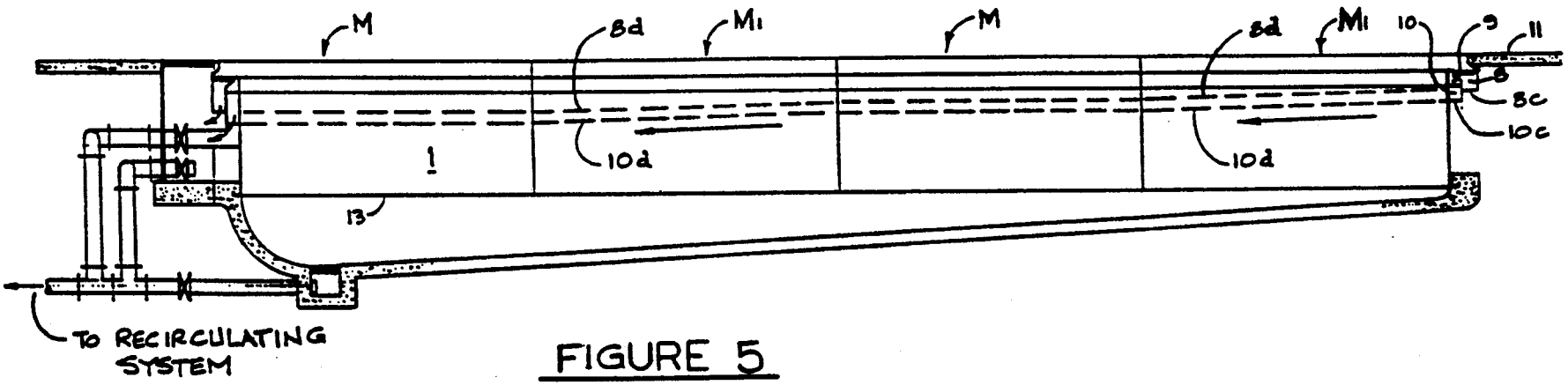
FIG. 5 represents a view of the pool-side retaining wall of a swimming pool including retaining wall units as shown in FIGS. 3 and 4.

In this embodiment, unlike that of FIGS. 1 and 2, in the assembly of such modular units M and M1, as best seen in FIG. 5, one or more of the modular units M1 are selected, wherein the bottom 8*c* of open conduit 8 and the bottom 10*c* of closed conduit 10 slope downward to level 8*d* of the open conduit 8 and level 10*d* of the open conduit 10, as seen by the dashed lines, and are are thus inclined towards the outlets 0 from the gutters 8, 10 to expedite gravity water flow down the gutters 8 and 10 to the outlets 0 from the gutters.

Figure 6:
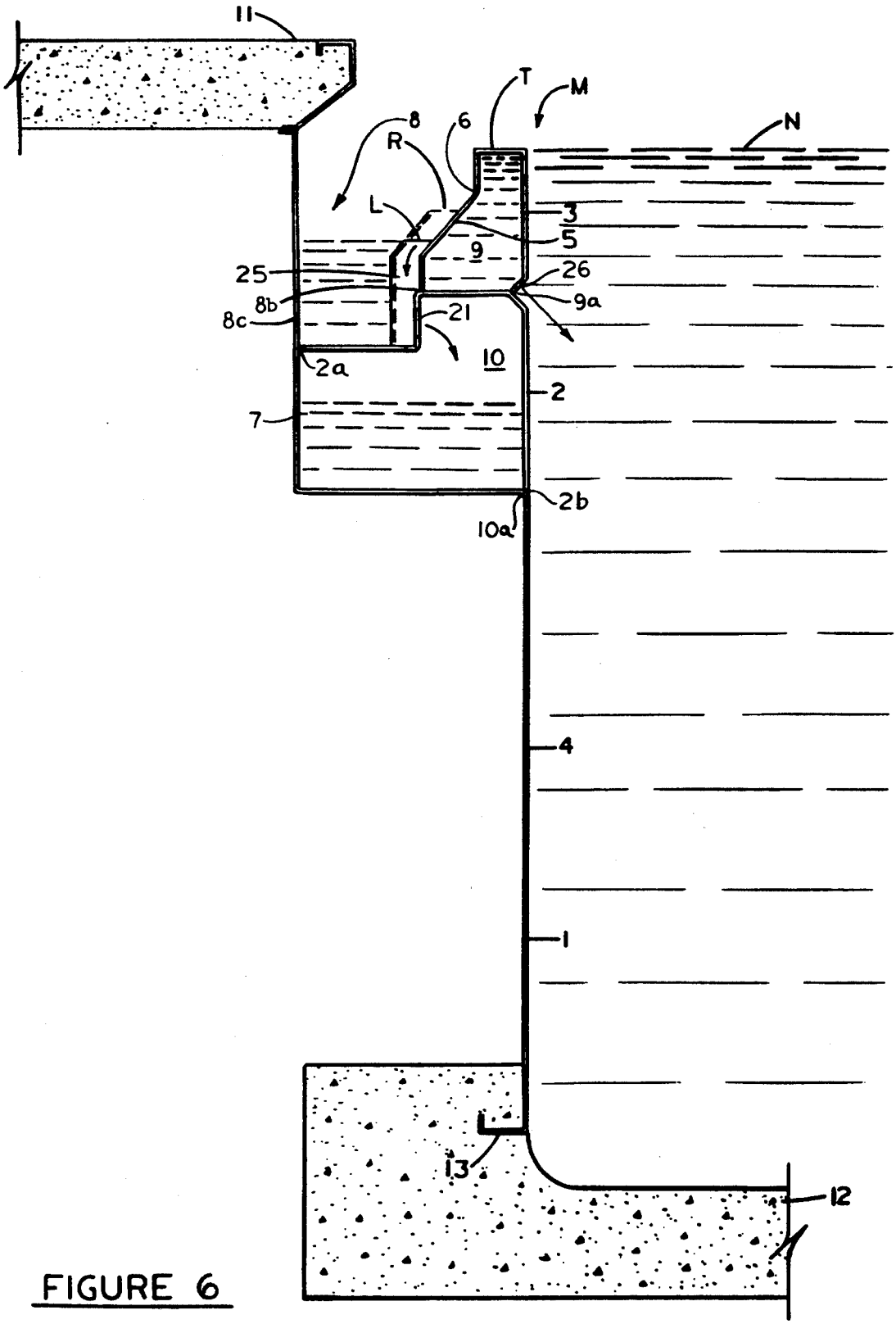
FIG. 6 represents an enlarged view in cross-section of a third embodiment of a perimeter skimming gutter and retaining wall unit in accordance with the invention.

The perimeter gutter and retaining wall unit of FIG. 6 is made up as the pool-side retaining wall of a swimming pool by combining a number of modular units M which are assembled in-shop or on-site and bonded-together at their ends by welding, soldering or brazing, to form a gutter and pool-side retaining wall extending around substantially the entire circumference of the swimming pool. Each unit M is made of stainless steel sheet, formed from three bonded-together sheets; 1, 2, 3:

(a) a first metal sheet 1 is so shaped as to define the pool-side retaining wall 4, the bottom and outer walls of the lower closed gutter conduit 10, and the rear walls of the upper open gutter conduit 8;

(b) an inverted U-shaped second metal sheet 2 so shaped as to define with the first metal sheet 1 the lower gutter conduit 10;

(c) an inverted U-shaped third metal sheet 3 so shaped as to define with the first and second metal sheets 1, 2 the upper open gutter conduit 8 and the upper closed water feed conduit 9.

The first metal sheet 1 is bonded to an end 2*a* of the second metal sheet 2 in exterior bonds along the outer side 8*c* of the upper open gutter conduit 8, and to another end 2*b* of the second metal sheet along a bottom corner 10*a* of the lower closed gutter conduit 10, thereby completing the bottom, top and sides of the lower closed gutter conduit.

The second metal sheet 2 is bonded to the third metal sheet 3 is exterior bonds along one side 8*b* of the upper open gutter conduit 8, thereby with the first metal sheet 1 completing the sides and bottom of the upper open gutter conduit 8, and along the bottom corner 9*a* of the upper closed water feed conduit 9, thereby completing the sides, top and bottom of the water feed conduit 9.

A plurality of apertures 21 through the second metal sheet 2 along the bottom of the open gutter conduit 8 for flow of gutter water therefrom into the lower closed gutter conduit 10.

The water feed conduit 9 is adapted to carry clean water feed to the pool, and the upper and lower gutter conduits 8, 10 are adapted to carry gutter water away from the pool.

The pool-sides of bonded-together sheets 1, 2 and 3 are designed to serve together as the pool retaining wall 4 on the pool-side of the gutter. The opposite inner sides of bonded-together sheets 1, 2 and 3 serve together as the side wall 5 of the open gutter 8 on the gutter side of the retaining wall and as the side wall 6 of the water feed conduit 9 and as the side wall 7 of the closed gutter conduit 10.

Figure 7:
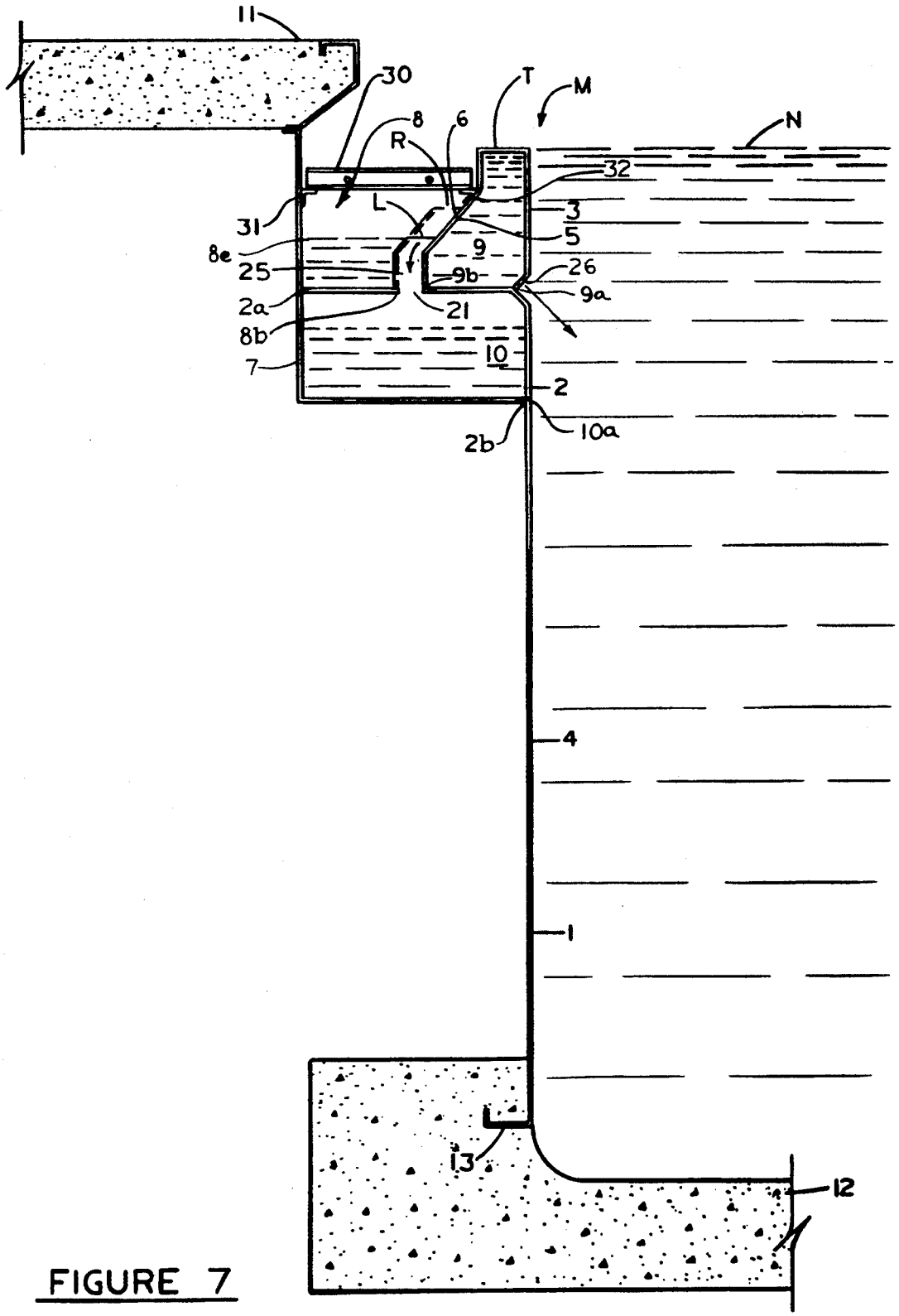
FIG. 7 represents an enlarged view in cross-section of a fourth embodiment of a perimeter skimming gutter and retaining wall unit in accordance with the invention.

The perimeter gutter and retaining wall unit of FIG. 7 is made up as the retaining wall of a swimming pool by combining a number of modular units M which are assembled in-shop or on-site and bonded-together at their ends by welding, soldering or brazing to form a gutter and pool-side retaining wall extending around substantially the entire circumference of the swimming pool. Each unit M is made of stainless steel sheet, formed from three bonded-together portions; 1, 2, 3:

(a) a first metal sheet 1 so shaped as to define the pool-side retaining wall 4, the bottom and outer walls of the lower closed gutter conduit 10, and the rear wall of the upper open gutter conduit 8;

(b) an inverted L-shaped second metal sheet 2 so shaped as to define with the first metal sheet the lower gutter conduit 10;

(c) an inverted U-shaped third metal sheet 3 so shaped as to define with the second metal sheet the upper open gutter conduit 8 and the upper closed water feed conduit 9.

The first metal sheet 1 is bonded to an end 2*a* of the second metal sheet 2 in exterior bonds along an outer side 8*e* of the upper open gutter conduit 8, and to another end 2*b* of the second metal sheet along a bottom corner 10*a* of the lower closed gutter conduit 10, thereby completing, with the first sheet, the bottom, top and sides of the lower closed gutter conduit.

The second metal sheet 2 is bonded to an end 9*b* of the third metal sheet 3 in exterior bonds along the bottom 8*b* of the upper open gutter conduit 8, thereby, with the first and third metal sheets completing the sides of the upper open gutter conduit 8, and along the bottom corner 9*a* of the upper closed water feed conduit 9, thereby completing the sides, top and bottom of the water feed conduit.

A plurality of apertures 21 through the second metal sheet 2 along the bottom corner of the open gutter conduit 8 allow flow of gutter water therefrom into the lower closed gutter conduit 10.

The water feed conduit 9 is adapted to carry clean water feed to the pool, and the upper and lower gutter conduits 8, 10 are adapted to carry gutter water away from the pool.

The pool-sides of bonded-together sheets 1, 2 and 3 are designed to serve together as the pool retaining wall 4 on the pool-side of the gutter. The opposite inner sides of bonded-together sheets 1, 2 and 3 serve together as the side wall 5 of the open gutter 8 on the gutter side of the retaining wall, and as the side wall 6 of the water feed conduit 9 and as the side wall 7 of the closed gutter conduit 10.

Figure 8:
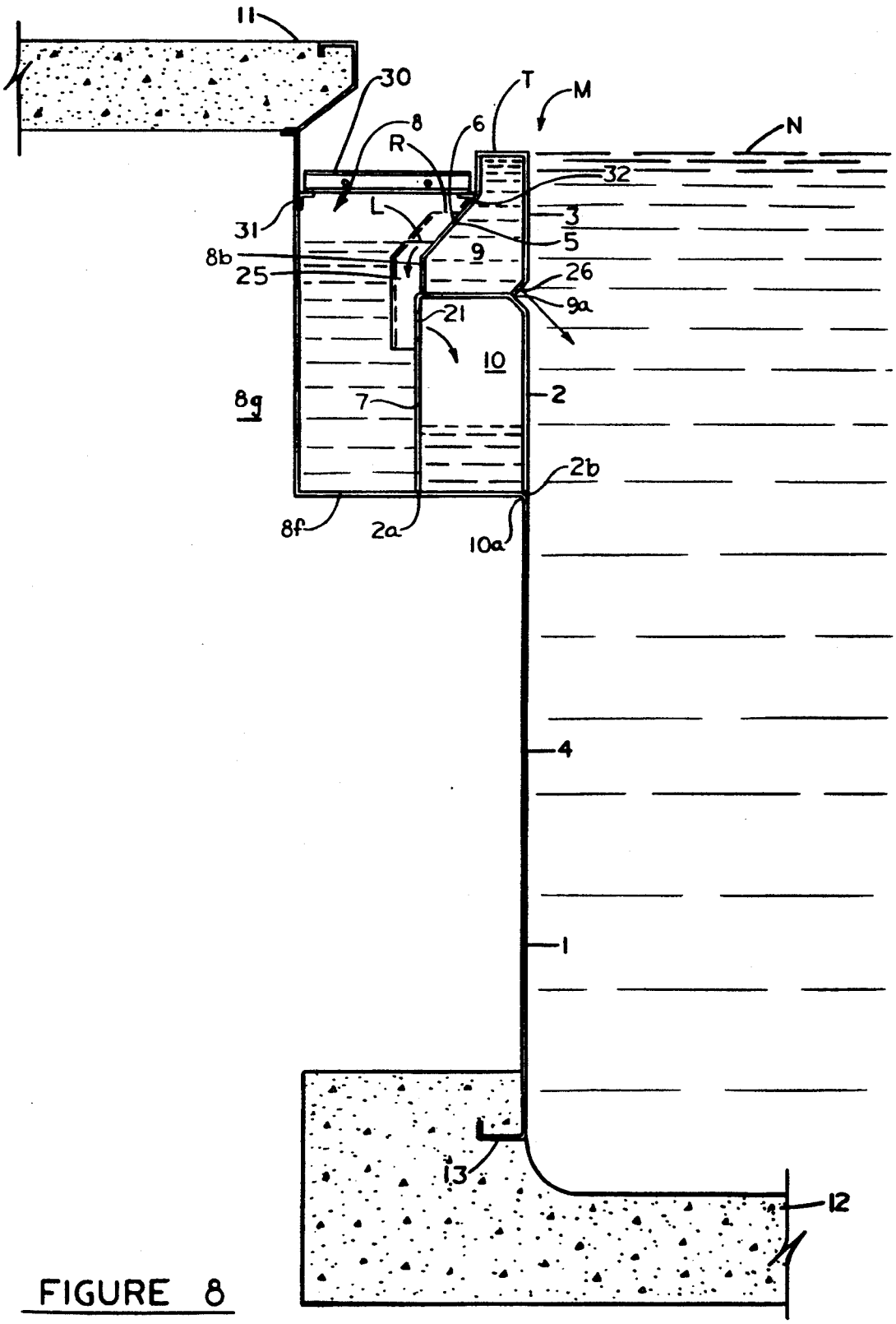
FIG. 8 represents an enlarged view in cross-section of a fifth embodiment of a perimeter skimming gutter and retaining wall unit in accordance with the invention.

The perimeter gutter and retaining wall unit of FIG. 8 is made up as the retaining wall of a swimming pool by combining a number of modular units M which are assembled in-shop or on-site and bonded-together at their ends by welding, soldering or brazing, to form a gutter and pool-side retaining wall extending around substantially the entire circumference of the swimming pool. Each unit M is made of stainless steel sheet, formed from three bonded-together sheets; 1, 2, 3:

(a) a first metal sheet 1 so shaped as to define the pool-side retaining wall 4, the bottom 10*f* of the lower closed gutter conduit 10, and the bottom 8*f* and rear 8*g* walls of the upper open gutter conduit 8;

(b) an inverted U-shaped second metal sheet 2 so shaped as to define with the first metal sheet 1 the remaining walls of the lower gutter conduit 10;

(c) an inverted U-shaped third metal sheet 3 so shaped as to define with the second metal sheet 2 the remaining walls of the upper open gutter conduit 8 and the upper closed water feed conduit 9.

The first metal sheet 1 is bonded to an end 2*a* of the second metal sheet 2 in exterior bonds along the bottom 8*f* of the upper open gutter conduit 8, and to one side at 2*b* of the second metal sheet 2 along a bottom corner 10*a* of the lower closed gutter conduit 10, thereby completing the bottom, top and sides of the lower closed gutter conduit.

The second metal sheet 2 is bonded to the third metal sheet 3 in exterior bonds along one side 8*b* of the upper open gutter conduit 8, thereby, with the first metal sheet 1 completing the sides of the upper open gutter conduit 8, and along the bottom corner 9*a* of the upper closed water feed conduit 9, thereby completing the sides, top and bottom of the water feed conduit 9.

A plurality of apertures 21 through the second metal sheet 2 along the bottom of the overflow channel 25 allow flow of gutter water therefrom into the lower closed gutter conduit 10.

The water feed conduit 9 is adapted to carry clean water feed to the pool, and the upper and lower gutter conduits 8, 10 are adapted to carry gutter water away from the pool.

The pool-sides of bonded-together sheets 2 and 3 are designed to serve together as the pool retaining wall 4 on the pool-side of the gutter. The opposite inner sides of bonded-together sheets 1, 2, and 3 serve together as the side wall 5 of the open gutter 8 on the gutter side of the retaining wall, and as the side wall 6, of the water feed conduit 9 and as the side wall 7 of the closed gutter conduit 10.

Figure 9:
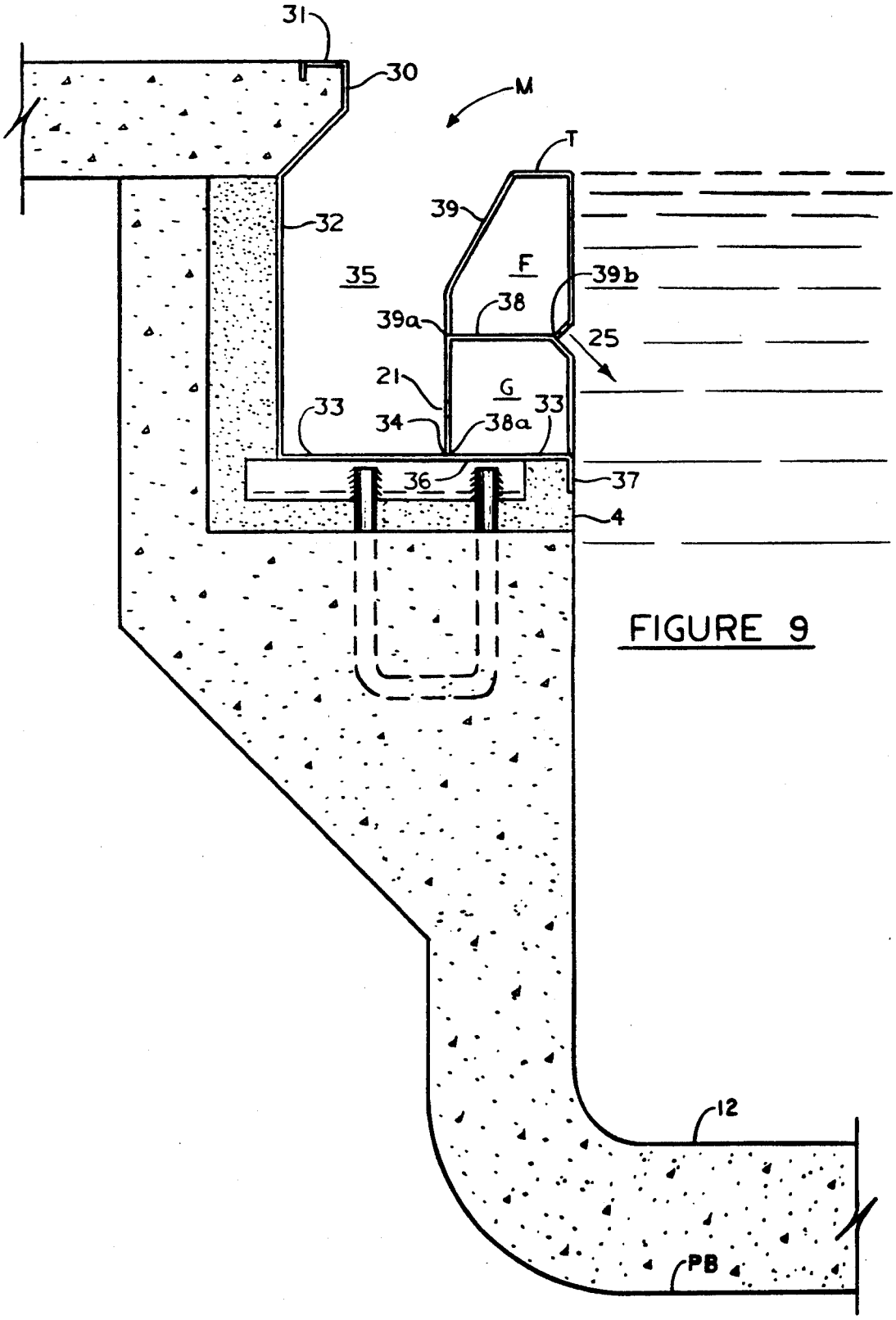
FIG. 9 represents an enlarged view in cross-section of a sixth embodiment of a perimeter skimming gutter and retaining wall unit in accordance with the invention; very similar to that of FIG. 8 except in the length of the pool retaining wall portion of the gutter.

The perimeter gutter and retaining wall unit of FIG. 9 is similar to that of FIGS. 1 and 2, but in this case the Sheet 1 forms only a very small portion of retaining wall 4. The unit is made up to lie on top of a concrete wall with which it forms the top of the retaining wall 4 of a swimming pool. A number of modular units M are assembled in-shop or on-site and bonded together at their ends by welding, soldering or brazing, to form a gutter and the upper part of the pool-side retaining wall extending around substantially the entire circumference of the swimming pool. Each unit M is made of stainless steel sheet formed from three bonded-together sheets:

(a) The first metal sheet 36 so shaped as to define a small portion 37 of the pool-side retaining wall 4, the bottom wall 33 of the lower closed gutter conduit G, and the bottom 34 and rear 32 walls of the upper open gutter conduit 35;

(b) an inverted U-shaped second metal sheet 38 so shaped as to define with the first metal sheet the gutter side and top and side walls of the lower gutter conduit G;

(c) an inverted U-shaped third metal sheet 39 so shaped as to define with the first and second metal sheets the upper open gutter conduit 35 and the upper closed water feed conduit F.

The first metal sheet 36 is bonded to an end 38*a* of the second metal sheet 38 in exterior bonds along a bottom corner 34*a* of the upper open gutter conduit 35, and to 38*b* of the second metal sheet along a bottom corner of the lower closed gutter conduit G, thereby completing the bottom, top and sides of the lower closed gutter conduit.

The second metal sheet 38 is bonded to one end 39*a* of the third metal sheet 39 in exterior bonds along one side of the upper open gutter conduit 35, thereby completing the sides and bottom of the upper open gutter conduit 35, and along the bottom corner 39*b* of the upper closed water feed conduit F, thereby completing the sides, top and bottom of the water feed conduit F.

A plurality of apertures 21 through the second metal sheet 38 along the bottom of the open gutter conduit 35 allow flow of gutter water therefrom into the lower closed gutter conduit G.

The water feed conduit F is adapted to carry clean water feed to the pool, and the upper and lower gutter conduits 35, G are adapted to carry gutter water away from the pool.

The pool-sides of bonded-together sheets 37, 38 and 39 are designed to serve together as the top portion of the pool retaining wall 4 on the pool-side of the gutter. The lower portion of the wall 4 is of concrete, and an integral part of the pool with the pool bottom PB. The opposite inner sides of bonded-together sheets serve together as the side wall of the open gutter on the gutter side of the retaining wall, and as the side walls of the water feed conduit and closed gutter conduit.

Figure 10:
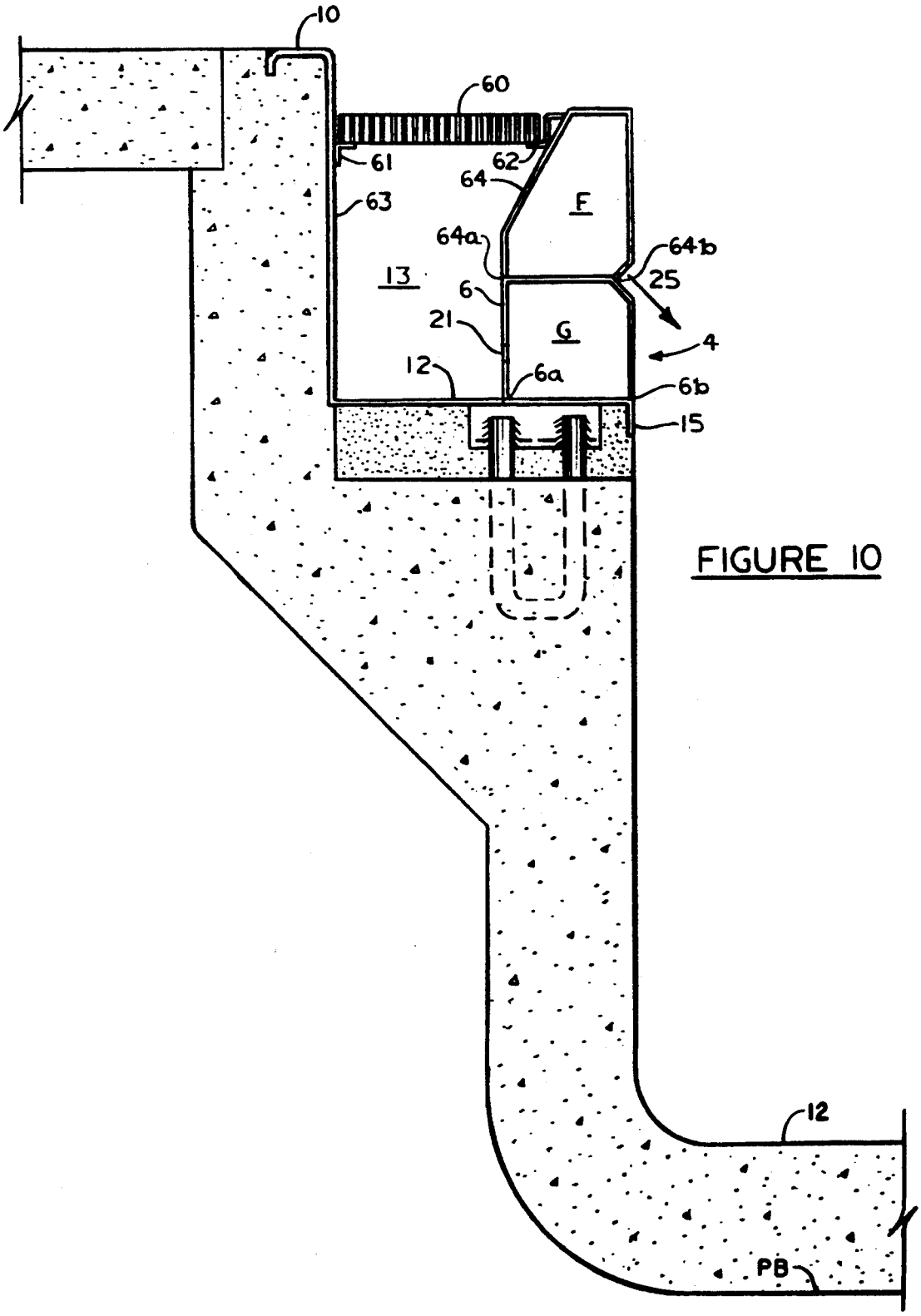
FIG. 10 represents an enlarged view in cross-section of a seventh embodiment of a perimeter skimming gutter and retaining wall unit in accordance with the invention; very similar to that of FIG. 8 except in the length of the pool retaining wall portion of the gutter.

The perimeter gutter and retaining wall unit of FIG. 10, like that of FIG. 9, forms only the top portion of the pool retaining wall 4. The remainder being of concrete, and is made up by combining a number of modular units which are assembled in-shop or on-site and bonded-together at their ends by welding, soldering or brazing, to form the gutter and top pool-side retaining wall extending around substantially the entire circumference of the swimming pool. Each unit is made of stainless steel sheet, formed from three bonded-together sheets;

(a) a first metal sheet 15 so shaped as to define a small portion of the pool-side retaining wall 4, the bottom wall of the lower closed gutter conduit G, and the bottom and rear walls of the upper open gutter conduit 13;

(b) an inverted U-shaped second metal sheet so shaped as to define with the first metal sheet the lower gutter conduit G;

(c) an inverted U-shaped third metal sheet 64 so shaped as to define with the second metal sheet the upper open gutter conduit and the upper closed water feed conduit F;

The first metal sheet 15 is bonded to an end 6*a* of the second metal sheet 6 in exterior bonds along a bottom corner of the upper open gutter conduit 13, and to another end 6*b* of the second metal sheet along a bottom corner of the lower closed gutter conduit G, thereby completing the bottom, top and sides of the lower closed gutter conduit G.

The second metal sheet 6 is bonded to the third metal sheet 64 in exterior bonds along one side of the upper open gutter conduit 13, thereby, with the first metal sheet 15 completing the sides and bottom of the upper open gutter conduit 13, and along the bottom corner of the upper closed water feed conduit F, thereby completing the sides, top and bottom of the water feed conduit F.

A plurality of apertures 21 through the second metal sheet 6 along the bottom of the open gutter conduit 13 allow flow of gutter water therefrom into the lower closed gutter conduit G.

The water feed conduit F is adapted to carry clean water feed to the pool, and the upper and lower gutter conduits 13, G are adapted to carry gutter water away from the pool.

The pool-sides of the bonded-together sheets are designed to serve together as the top portion of the pool retaining wall 4 on the pool-side of the gutter. The opposite inner sides of bonded-together sheets serve together as the side wall of the open gutter 13 on the gutter side of the retaining wall, and as the side walls of the water feed conduit F and closed gutter conduit G. The remainder of wall 4 is of concrete, integral with the swimming pool bottom PB.

Figure 11:
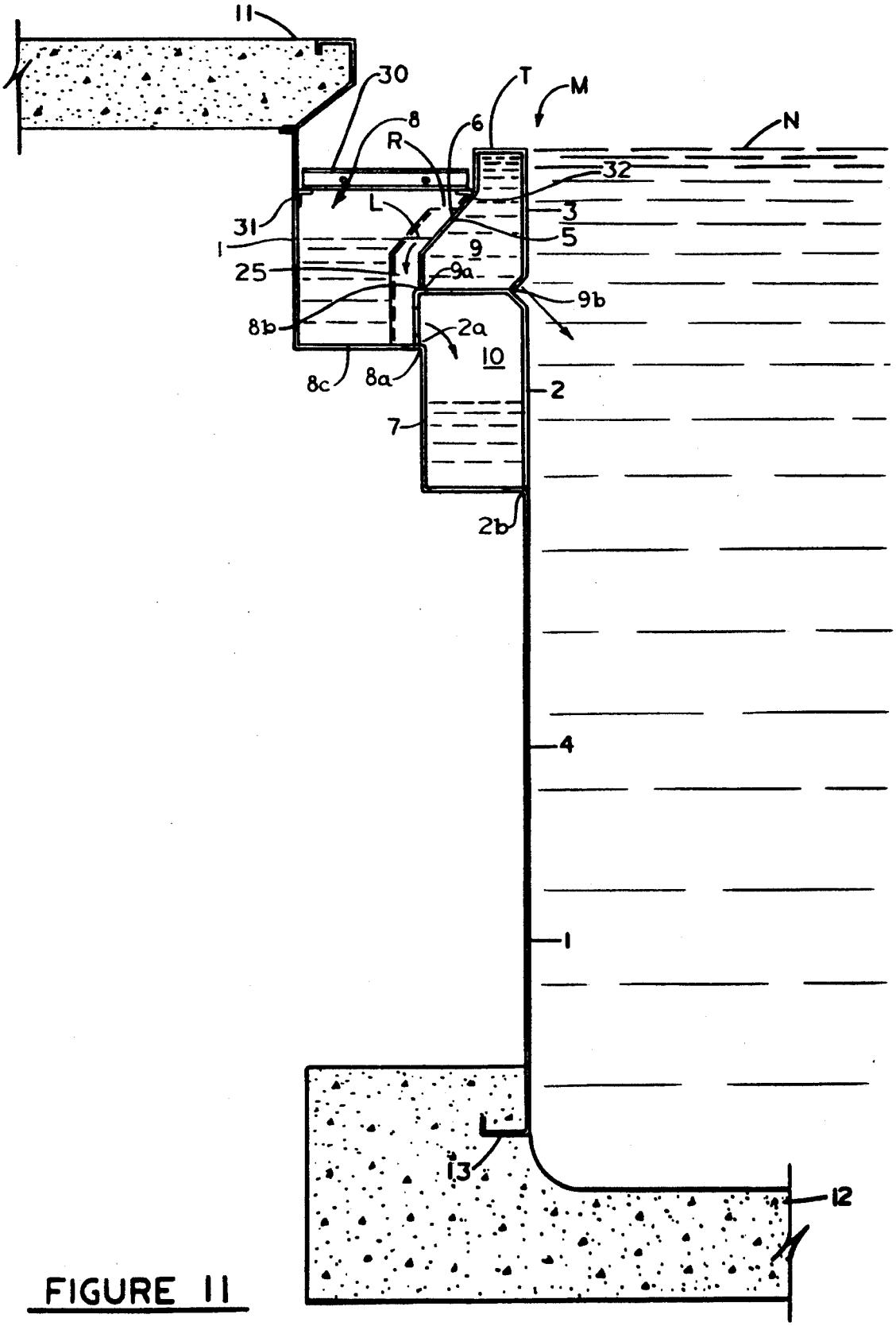
FIG. 11 represents an enlarged view in cross-section of an eighth embodiment of a perimeter skimming gutter and retaining wall unit in accordance with the invention; very similar except in the length of the pool retaining wall portion of the gutter to that of FIG. 8.

The perimeter gutter and retaining wall unit of FIG. 11 is made up as the retaining wall of a swimming pool by combining a number of modular units M which are assembled in-shop or on-site and bonded-together at their ends by welding, soldering or brazing to form a gutter and pool-side retaining wall extending around substantially the entire circumference of the swimming pool. Each unit M is made of stainless steel sheet, formed from three bonded-together sheets; 1, 2, 3:

(a) a first metal sheet 1 so shaped as to define the bottom and outer walls of the lower closed gutter conduit 10, and the bottom and rear walls of the upper open gutter conduit 8;

(b) an inverted U-shaped second metal sheet 2 so shaped as to define the pool-side retaining wall 4, and with the first metal sheet the lower gutter conduit 10;

(c) an inverted U-shaped third metal sheet 3 so shaped as to define with the second metal sheet the upper open gutter conduit 8 and the upper closed water feed conduit 9.

The first metal sheet 1 is bonded to an end 2*a* of the second metal sheet 2 in exterior bonds along the bottom 8*c* of the upper open gutter conduit 8, and the end 2*b* of the first sheet is bonded to the second metal sheet along a bottom corner 10*a* of the lower closed gutter conduit 10, thereby completing with the second sheet, the bottom, top and sides of the lower closed gutter conduit.

The second metal sheet 2 is bonded to an end 9*a* of the third metal sheet 3 in exterior bonds along the side 8*b* of the upper open gutter conduit 8, thereby with the first and third metal sheets completing the sides of the upper open gutter conduit 8, and along the bottom corner 9*b* of the upper closed water feed conduit 9, thereby completing the sides, top and bottom of the water feed conduit.

A plurality of apertures 21 through the second metal sheet 2 along the bottom corner of the open gutter conduit 8 allow flow of gutter water therefrom into the lower closed gutter conduit 10.

The water feed conduit 9 is adapted to carry clean water feed to the pool, and the upper and lower gutter conduits 8, 10 are adapted to carry gutter water away from the pool.

The pool-sides of bonded-together sheets 1, 2 and 3 are designed to serve together as the pool retaining wall 4 on the pool-side of the gutter. The opposite inner sides of bonded-together sheets 1, 2 and 3 serve together as the side wall 5 of the open gutter 8 on the gutter side of the retaining wall, and as the side wall 6 of the water feed conduit 9 and as the side wall 7 of the closed gutter conduit 10.

The removable grating 30 supported on flanges 31 and 32 covers the gutter trough 8 and protects swimmers from injury in plunging into the trough.

The perimeter gutter retaining walls shown in the drawings are made of stainless steel, but it will, of course, be understood that other metals can be used, such as galvanized iron and steel, and aluminum, as well as anodized aluminum. Whatever the metallic material, its surface should be treated so as to render it corrosion-resistant, as by plating, galvanizing, anodizing, porcelain-enamel coating, or painting. It is also possible to form the perimeter gutter of plastic material, either in whole or in part. There are plastics now available which are sufficiently strong to withstand the wear and tear of a perimeter gutter system, including, for example, acrylonitrile-butadiene-styrene resin, polycarbonate resin, polytetrafluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The preferred construction is from a sheet or several sheets of metallic or plastic material, which are formed into the desired configuration, as is seen in the cross-sectional drawings. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grid of metal or plastic, the same or different material from the gutter, as shown in the embodiments of FIGS. 1 and 2, 3 and 4, 7, 8 and 10.

The use of modular units such as are shown in the drawings, is preferred, because this permits mass production of the gutter system at a point remote from the swimming pool, with easy and inexpensive transportation from that point to swimming pool construction sites anywhere in the world. The modular units can then be assembled on-site to form any type of configuration of swimming pool. The modular units can be made in straight sections for rectangular or other straight-sided pool shapes, while curved sections can be made for pear-shaped, elliptical, circular or other round-sided pool configurations.

The modular units can be fitted together by welding, soldering or brazing, in the case of metal units, by bonding, using various types of adhesives, in the case of metal or plastic units; or by heat-sealing, ultrasonic welding, or heat-bonding in the case of thermoplastic plastic units. Plastic units which are not fully heat-cured can be bonded and then cured in situ to form a permanent bond on-site, in the course of construction of the pool.

The perimeter gutter system of the invention can be used completely around the pool perimeter, as desired.

The most uniform skimming action and gutter action is of course obtained when the entire perimeter of the pool is provided with such a gutter.

The pool-side retaining wall as shown provides two separate conduits, of which either can be used for water feed or gutter flow, as desired. While in the preferred embodiment shown in the drawings the upper is used as a water feed conduit, and lower a gutter conduit, the upper can serve as a gutter conduit and lower as a water feed conduit, as in U.S. Pat. Nos. 3,668,712, 3,668,713, 3,668,714 and 4,050,104.

The openings can be of any desired size and shape providing a sufficient drain action. Preferably, they are elongated and substantially horizontal, but they can be vertical or at any angle in between. They also should limit flow to prevent surges and waves from entering, and hence are narrow. They should not exceed about one inch in height and should have a length to height ratio of from 1:1 to 100:1, although the latter limit is not critical. The limit is actually imposed only by the feasible length of gutter section and the strength of the material used for the retaining wall.

The swimming pool can be equipped with water filtration and cleaning recirculation systems. The gutters usually feed water therein to such systems by gravity. Pumps can be provided, and the gutters can also be provided with jet water inlets to direct a driving flow of water along the gutters, to flush out the gutters, and to drive water along the gutter towards the water recirculation system. Such jet water inlets are described in U.S. Pat. No. 2,932,397 to Ogden, dated Apr. 12, 1960. An alternative is a downward slope or inclination of the gutter bottoms, so as to enhance flow by gravity to the water recirculation system as illustrated in FIGS. 3, 4 and 5.

Having regard to the foregoing disclosure, the following is claimed as the inventive and patentable embodiments thereof:

1. A modular perimeter skimming gutter and retaining wall for swimming pools with exposed exterior longitudinal welds, for pool construction by simple bonding together of a plurality of modular units in the shop or on-site, disposed about a swimming pool as the retaining wall of the swimming pool, comprising:

(1) an open first conduit;
(2) a closed second conduit;
(3) a closed third conduit; and
(4) at least a portion of a pool-side retaining wall;

the open first conduit being constructed and arranged to carry water at a level below a predetermined level of water in the swimming pool, and over which retaining wall water may flow from the pool into the open first conduit; the modular unit comprising three welded-together metal sheet portions:

(a) a first metal sheet so shaped as to define walls of the closed second or third conduit and walls of the open first conduit;
(b) a second metal sheet so shaped as to define with the first metal sheet other walls of the closed second conduit and walls of the closed third conduit;
(c) one of the first and second sheets so shaped as to define at least a portion of the pool-side retaining wall; and
(d) a third metal sheet so shaped as to define with the first or second sheets, walls of the open first conduit and of the closed third conduit;

the first metal sheet being welded with an exposed exterior weld to the second sheet along a wall of the open first conduit, and to the second sheet along a wall of the closed second conduit, thereby completing the walls of the closed second conduit;

the third sheet being welded to the second sheet with exposed exterior welds along a wall of open first conduit, thereby with the first sheet completing the walls of said the open first conduit, and along a wall of the closed second conduit, thereby completing the walls of the closed third conduit;

a plurality of apertures through one of the second or third metal sheets along a wall of the open first conduit for flow of gutter water therefrom into the closed second conduit; and one of the closed second and third conduits being constructed and arranged to carry gutter water away from the pool.

2. A perimeter skimming gutter and retaining wall unit for swimming pools in accordance with claim 1 in which the two closed conduits are in parallel vertical alignment.

3. A perimeter skimming gutter retaining wall in accordance with claim 1, comprising an open grid extending over the open first conduit.

4. A perimeter skimming gutter retaining wall in accordance with claim 1, in the form of a modular unit constructed and arranged to be assembled with other such units to form the perimeter retaining wall of a swimming pool.

5. A perimeter skimming gutter retaining wall in accordance with claim 1, in which the three sheets are of stainless steel.

6. A perimeter skimming gutter and retaining wall unit for swimming pools in accordance with claim 1, in which at least one of the conduits has a downward slope for gravity flow of water there along to enhance flow away from the pool.

7. A perimeter skimming gutter retaining wall in accordance with claim 6, in which two of the conduits have a downward slope.

8. A swimming pool comprising side walls and a bottom constructed and arranged to retain water therewithin, and, extending about the upper perimeter of at least a portion of one side wall thereof, a perimeter skimming gutter retaining wall in accordance with claim 7.

9. A perimeter skimming gutter retaining wall in accordance with claim 6, in the form of a modular unit constructed and arranged to be assembled with other such units, at least one of which is of corresponding downward slope, to form the perimeter retaining wall of a swimming pool with an interconnecting downward slope along the length of the first.

10. A swimming pool comprising side walls and a bottom constructed and arranged to retain water therewithin, and, extending about the upper perimeter of at least a portion of one side wall thereof, a perimeter skimming gutter retaining wall in accordance with claim 9.

11. A swimming pool comprising side walls and a bottom constructed and arranged to retain water therewithin, and, extending about the upper perimeter of at least a portion of one side wall thereof, a perimeter gutter and retaining wall unit in accordance with claim 6.

12. A swimming pool in accordance with claim 11 including a water cleaning and recirculating system for collecting water flowing into and along the open first conduit, cleaning it, and returning it to the pool.

13. A swimming pool comprising side walls and a bottom constructed and arranged to retain water therewithin, and, extending about the upper perimeter of at least a portion of one side wall thereof, a perimeter gutter and retaining wall unit in accordance with claim 1.

14. A swimming pool in accordance with claim 13 including a water cleaning and recirculating system for collecting water flowing into and along the gutter conduit, cleaning it, and returning it to the pool.

15. A perimeter skimming gutter retaining wall for swimming pools in accordance with claim 1, comprising an overflow control means defining an overflow level for flow from the open first conduit to the closed second conduit through the wall therebetween.

16. A swimming pool comprising side walls and a bottom constructed and arranged to retain water therewithin, and extending about the upper perimeter of at least a portion of one side wall thereof, a perimeter skimming gutter retaining wall in accordance with claim 15.

17. A perimeter skimming gutter retaining wall for swimming pools in accordance with claim 16, comprising means for adjusting the level of the overflow with respect to the water level in the open first conduit.

18. A swimming pool comprising side walls and a bottom constructed and arranged to retain water therewithin, and, extending about the upper perimeter of at least a portion of one side wall thereof, a perimeter skimming gutter retaining wall in accordance with claim 17.

19. A modular perimeter skimming gutter and retaining wall unit for swimming pools comprising:

(1) an upper open gutter conduit, (2) a lower closed gutter conduit, (3) an upper closed water feed conduit, and (4) a pool-side retaining wall;

the open gutter conduit being constructed and arranged to carry water at a level below a level of water in the swimming pool, and over the top of which retaining wall water may flow from the pool into the open gutter conduit;

the modular unit comprising three welded-together metal sheet portions:

(a) a pool-side retaining wall of first metal sheet so shaped as to define the pool-side retaining wall, the bottom and outer walls of the lower closed gutter conduit, and the bottom and rear walls of the upper open gutter conduit;

(b) an inverted U-shaped second metal sheet so shaped as to define with the first metal sheet the lower gutter conduit;

(c) an inverted U-shaped third metal sheet so shaped as to define with the first and second metal sheets the upper open gutter conduit and the upper closed water feed conduit;

the first metal sheet being bonded to an end of the second metal sheet in exposed exterior welds along a bottom corner of the upper open gutter conduit; and to another end of the second metal sheet along a bottom corner of the lower closed gutter conduit, thereby completing the bottom, top and sides of the lower closed gutter conduit;

the third metal sheet being welded to the second metal sheet in exposed exterior welds along one side of the upper open gutter conduit, thereby with the first metal sheet completing the sides and bottom of the upper gutter conduit; and then bonded along the bottom corner of the lower closed water feed conduit, thereby completing the sides, top and bottom of the water feed conduit, and a plurality of apertures through the second metal sheet along the bottom of the open gutter conduit for flow of gutter water therefrom into the lower closed gutter conduit;

the water feed conduit being constructed and arranged to carry clean water feed to the pool, and the upper and lower gutter conduits being adapted to carry gutter water away from the pool.

20. A perimeter skimming gutter and retaining wall unit for swimming pools in accordance with claim 19 in which the two closed conduits are in parallel vertical alignment.

21. A perimeter swimming gutter retaining wall in accordance with claim 19 comprising an open grid extending over the open gutter conduit.

22. A perimeter skimming gutter retaining wall in accordance with claim 19 in the form of a modular unit adapted to be assembled with other such units to form the perimeter gutter retaining wall of a swimming pool.

23. A perimeter skimming gutter retaining wall in accordance with claim 19 in which the three sheets are of stainless steel.

24. A perimeter skimming gutter and retaining wall unit for swimming pools in accordance with claim 19 in which at least one of the two gutter conduits has a downward slope for gravity flow of water there along to enhance flow away from the pool.

25. A perimeter skimming gutter retaining wall in accordance with claim 24 in which both of the gutter conduits has a downward slope.

26. A swimming pool comprising side walls and a bottom constructed and arranged to retain water therewithin, and, extending about the upper perimeter of at least a portion of one side wall thereof, a perimeter skimming gutter retaining wall in accordance with claim 25.

27. A perimeter skimming gutter retaining wall in accordance with claim 24 in the form of a modular unit constructed and arranged to be assembled end to end with other such units of corresponding downward slope to form the perimeter gutter retaining wall of a swimming pool with an interconnecting downward slope along the length of the gutter.

28. A swimming pool comprising side walls and a bottom constructed and arranged to retain water therewithin, and, extending about the upper perimeter of at least a portion of one side wall thereof, a perimeter skimming gutter retaining wall in accordance with claim 27.

29. A swimming pool comprising the walls and a bottom constructed and arranged to retain water therewithin, and, extending about the upper perimeter of at least a portion of one side wall thereof, a perimeter gutter and retaining wall unit in accordance with claim 24.

30. A swimming pool in accordance with claim 29 including a water cleaning and recirculating system for collecting water flowing into and along the gutter conduit, cleaning it, and returning it to the pool.

31. A swimming pool comprising side walls and a bottom constructed and arranged to retain water therewithin, and, extending about the upper perimeter of at least a portion of one side wall thereof, a perimeter gutter and retaining wall unit in accordance with claim 21.

32. A swimming pool in accordance with claim 31 including a water cleaning and recirculating system for collecting water flowing into and along the gutter conduit, cleaning it, and returning it to the pool.

33. A perimeter skimming gutter retaining wall for swimming pools in accordance with claim 19 comprising an overflow control means defining an overflow level for flow from the open gutter conduit to the closed gutter conduit through the wall therebetween.

34. A swimming pool comprising side walls and a bottom adapted to retain water therewithin, and extending about the upper perimeter of at least a portion of one side wall thereof, a perimeter skimming gutter retaining wall in accordance with claim 33.

35. A perimeter skimming gutter retaining wall for swimming pools in accordance with claim 34 comprising means for adjusting the level of the overflow with respect to the water level in the open gutter conduit.

36. A swimming pool comprising side walls and a bottom constructed and arranged to retain water therewithin, and, extending about the upper perimeter of at least a portion of one side wall thereof, a perimeter skimming gutter retaining wall in accordance with claim 35.

* * * * *